US011705031B2

(12) United States Patent
Lin

(10) Patent No.: US 11,705,031 B2
(45) Date of Patent: Jul. 18, 2023

(54) SOURCE DRIVER AND COMPOSITE LEVEL SHIFTER

(71) Applicant: SITRONIX TECHNOLOGY CORP., Jhubei (TW)

(72) Inventor: Sheng-Yu Lin, Jhubei (TW)

(73) Assignee: Sitronix Technology Corp., Jhubei (TW)

( * ) Notice: Subject to any disclaimer, the term of this patent is extended or adjusted under 35 U.S.C. 154(b) by 0 days.

(21) Appl. No.: 16/589,381

(22) Filed: Oct. 1, 2019

(65) Prior Publication Data

US 2021/0043122 A1 Feb. 11, 2021

Related U.S. Application Data

(60) Provisional application No. 62/739,350, filed on Oct. 1, 2018.

(51) Int. Cl.
*G09G 3/20* (2006.01)

(52) U.S. Cl.
CPC ..... *G09G 3/20* (2013.01); *G09G 2310/027* (2013.01); *G09G 2310/0278* (2013.01); *G09G 2310/0289* (2013.01); *G09G 2310/0291* (2013.01); *G09G 2320/0276* (2013.01)

(58) Field of Classification Search
CPC .. G09G 3/20; G09G 3/32; G09G 3/36; G09G 2310/027; G09G 2310/0278; G09G 2310/0289; G09G 2310/0291; G09G 2310/0276; G09G 3/3614; G09G 3/3677; G09G 3/3607; G09G 2310/0254;
(Continued)

(56) References Cited

U.S. PATENT DOCUMENTS 9,311,844 B2 4/2016 Yang
9,991,903 B2 6/2018 Kim
(Continued)

FOREIGN PATENT DOCUMENTS

CN 1170183 A * 1/1998
CN 1464498 A 12/2003
(Continued)

OTHER PUBLICATIONS

Office Action and Search Report for counterpart Chinese Application No. 201910950569.7, dated Apr. 26, 2021.
(Continued)

*Primary Examiner* — Nitin Patel
*Assistant Examiner* — Cory A Almeida
(74) *Attorney, Agent, or Firm* — Rosenberg, Klein & Lee

(57) ABSTRACT

The invention relates to a source driver and a composite level shifter. The source driver comprises a data buffer circuit, a plurality of level shifters and a plurality of driving circuits. The data buffer circuit receives and registers a plurality of pixel data during a driving period. The level shifters convert the voltage levels of the pixel data registered in the data buffer circuit during the driving period. The driving circuits generate a plurality of source signals according to the converted pixel data during driving period. The data buffer circuit may comprise a plurality of composite level shifters for converting the voltage levels of the pixel data, and latching the converted pixel data.

15 Claims, 11 Drawing Sheets

(58) Field of Classification Search
CPC ... G09G 2310/0286; G09G 2300/0809; G11C 19/184
See application file for complete search history.

(56) References Cited

U.S. PATENT DOCUMENTS

| | | | | |
|---|---|---|---|---|
| 2005/0162372 | A1* | 7/2005 | Hashimoto | G09G 3/3648 345/99 |
| 2006/0077491 | A1 | 4/2006 | Morita | |
| 2010/0002021 | A1* | 1/2010 | Hashimoto | G09G 3/2003 345/88 |
| 2013/0076722 | A1* | 3/2013 | Choi | G09G 3/348 345/212 |
| 2015/0339962 | A1 | 11/2015 | Ryu | |

FOREIGN PATENT DOCUMENTS

| | | | |
|---|---|---|---|
| CN | 1834742 | A | 9/2006 |
| CN | 101083061 | A | 12/2007 |
| CN | 101140746 | A | 3/2008 |
| CN | 101533598 | A | 9/2009 |
| CN | 102768818 | A | 11/2012 |
| TW | 201310426 | A | 3/2013 |

OTHER PUBLICATIONS

Office Action and Search Report for counterpart Taiwanese Application No. 108135588, dated Jun. 12, 2020.

* cited by examiner

SOURCE DRIVER AND COMPOSITE LEVEL SHIFTER

FIELD OF THE INVENTION

The present invention relates generally to a driver, and particularly to a source driver and a composite level shifter.

BACKGROUND OF THE INVENTION

Please refer to FIG. 1, which shows a circuit diagram of the display device according to the prior art. As shown in the figure, the display device includes a display panel 10 and a source driver. The source driver is coupled to the display panel 10. The source driver includes a shift register 1, an input latch 3, a data latch 5, a plurality of level shifters 7, and a plurality of driving circuits 9. The shift register 1, the input latch 3, and the data latch 5 can be used as a data buffer circuit.

Please refer to FIG. 2, which shows a timing diagram of the operation of the source driver according to the prior art. As shown in the figure, by using the data buffer technology for the source driver according to the prior art, during the scan period for the m-th scan signal, the plurality of level shifters 7 convert the voltage levels of the Q-th data and output the converted Q-th data to the plurality of driving circuits 9. The plurality of driving circuits 9 generate a plurality of source signals according to the converted Q-th data for driving the display panel 10 to display the image corresponding to the Q-th data. In this scan period for the m-th scan signal, the (Q+1)-th data are first transmitted to the input latch 3 of the data buffer circuit for registering. In the scan period for the (m+1)-th scan signal, the (Q+1)-th data registered in the input latch 3 are output to the data latch 5 for providing the (Q+1)-th data to the plurality of level shifters 7, and thus converting the voltage levels of the (Q+1)-th data and outputting the converted (Q+1)-th data to the plurality of driving circuits 9 for driving the display panel 10 to display the image corresponding to the (Q+1)-th data. In this scan period for the (m+1)-th scan signal, the (Q+2)-th data are first transmitted to the input latch 3 of the data buffer circuit for registering. In the scan period for the (m+2)-th scan signal, the (Q+2)-th data are transmitted to the data latch 5 for providing the (Q+2)-th data to the plurality of level shifters 7, and thus the driving circuit 9 can drive the display panel 10 to display the image corresponding to the (Q+2)-th data. In this scan period for the (m+2)-th scan signal, the (Q+3)-th data are first transmitted to the input latch 3 of the data buffer circuit for registering.

Based on data buffer technology for the source driver according to the prior as described above, the data required for displaying the image in the next scan period must be registered in advance. Thereby, the data buffer circuit requires the data latch 5 to latch data, which needs an extra circuit and its layout area. In addition, when the resolution of the display device increases, the data to be latched in the data latch 5 increase, further increasing circuit and its layout area.

Accordingly, the present invention provides a source driver and a composite level shifter for simplifying circuit and reducing its layout area.

SUMMARY

An objective of the present invention is to provide a source driver for simplifying circuit and reducing its layout area.

Another objective of the present invention is to provide a composite level shifter for converting the voltage level of data and latching the converted data. Thereby, the circuit may be simplified and its layout area may be reduced.

The present invention relates to a source driver, which comprises a data buffer circuit, a plurality of level shifters, and a plurality of driving circuits. The data buffer circuit receives and registers a plurality of pixel data in a driving period. The plurality of level shifters are coupled to the data buffer circuit, and convert the voltage levels of the plurality of pixel data registered in the data buffer circuit in the driving period. The plurality of driving circuits are coupled to the plurality of level shifters, and generate a plurality of source signals according to the plurality of pixel data converted by the plurality of level shifters in the driving period.

The present invention relates to a source driver, which comprises a data buffer circuit and a plurality of driving circuits. The data buffer circuit receives a plurality of pixel data, converts the voltage levels of the plurality of pixel data, and latches the plurality of converted pixel data. The plurality of driving circuits are coupled to the data buffer circuits and generates a plurality of source signals according to the plurality of converted pixel data.

The present invention relates to a composite level shifter, which converts the voltage level of data and latches the converted data.

DETAILED DESCRIPTION

In the specifications and subsequent claims, certain words are used for representing specific devices. A person having ordinary skill in the art should know that hardware manufacturers might use different nouns to call the same device. In the specifications and subsequent claims, the differences in names are not used for distinguishing devices. Instead, the differences of devices in whole techniques are the guidelines for distinguishing. In the whole specifications and subsequent claims, the word "comprising" is an open language and should be explained as "comprising but not limited to". Besides, the word "couple" includes any direct and indirect electrical connection. Thereby, if the description is that a first device is coupled to a second device, it means that the first device is connected to the second device directly, or the first device is connected to the second device via other device or connecting means indirectly.

Figure 3:
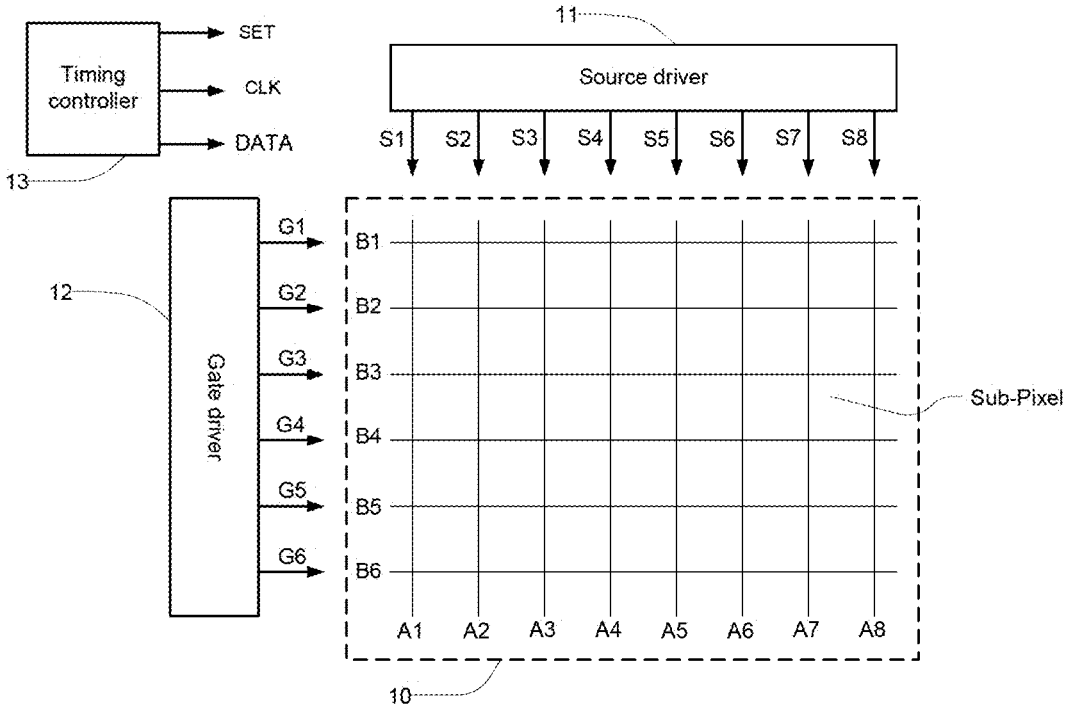
FIG. 3 shows a schematic diagram of the display device according to an embodiment of the present invention.

Please refer to FIG. 3, which shows a schematic diagram of the display device according to an embodiment of the present invention. As shown in the figure, the display device includes a display panel 10, a source driver 11, a gate driver 12, and a timing controller 13. The timing controller 13 is coupled to the source driver 11 and the gate driver 12. The source driver 11 and the gate driver 12 are coupled to the display panel 10, respectively. The timing controller 13 outputs a set signal SET, a clock signal CLK, and a plurality of pixel data DATA to the source driver 11. The timing controller 13 also outputs the clock signal CLK to the gate driver 12. According to an embodiment of the present invention, each of the pixel data DATA may be 18-bit data. For example, the resolution of red (R), green (G), and blue (B) is 6 bit, respectively, meaning that the resolution of each sub-pixel is 6 bit. Thereby, each time the timing controller 13 may output a set of 18-bit pixel data DATA. Nonetheless, the present invention is not limited to the embodiment. According to the present embodiment, the timing controller 13 serially transmits the plurality of pixel data DATA.

The display panel 10 includes a plurality of source lines A1, A2, A3, A4, A5, A6, A7, A8 and a plurality of gate lines B1, B2, B3, B4, B5, B6. The plurality of source lines A1~A8 are coupled to the source driver 11; the plurality of gate lines B1~B6 are coupled to the gate driver 12. The source driver 11 outputs a plurality of source signals S1, S2, S3, S4, S5, S6, S7, S8 to a plurality of sub-pixels Sub-Pixel of the display panel 10 via the plurality of source lines A1~A8. Each sub-pixel Sub-Pixel includes a transistor, a storage capacitor, and a liquid-crystal capacitor. Since a person having ordinary skill in the art knows the structure well, to simplify figures, the figure of the structure is omitted. The gate driver 12 outputs a plurality of scan signals G1, G2, G3, G4, G5, G6 to the plurality of sub-pixels Sub-Pixel of the display panel 10 via the plurality of gate lines B1~B6 for controlling the plurality of sub-pixels Sub-Pixel to receive the plurality of source signals S1~S8.

Figure 4:
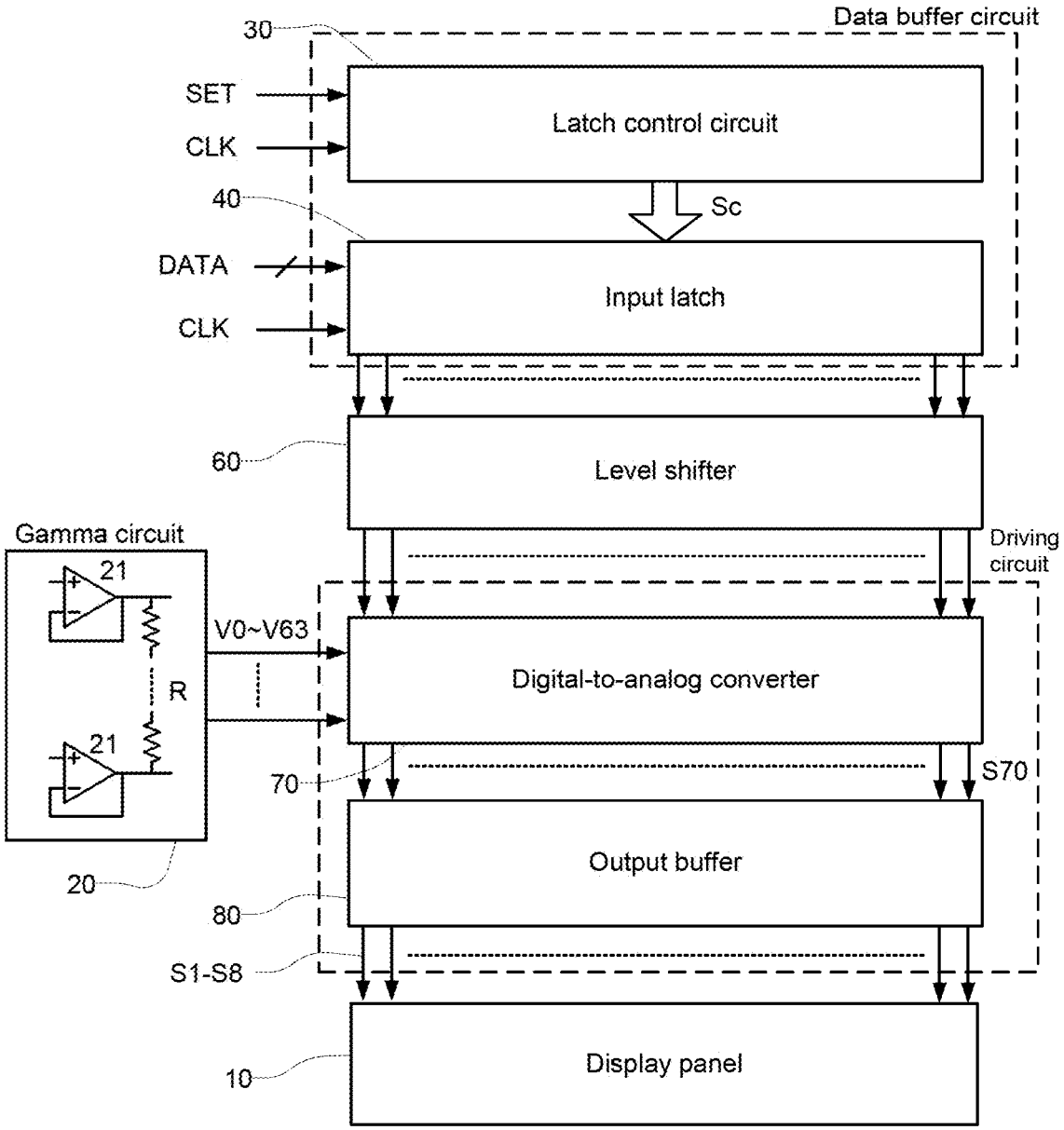
FIG. 4 shows a circuit diagram of the source driver according to the first embodiment of the present invention.

Please refer to FIG. 4, which shows a circuit diagram of the source driver according to the first embodiment of the present invention. As shown in the figure, the source driver 11 comprises a data buffer circuit, a plurality of level shifters 60, and a plurality of driving circuits. The source driver 11 further includes a gamma circuit 20, which generates a plurality of gamma signals V0~V63 to the driving circuit. The plurality of gamma signals V0~V63 have different voltage levels corresponding to different greyscales. The gamma circuit 20 shown in FIG. 4 is used to illustrate the operation of the source driver 11. The detailed circuit is not shown. The gamma circuit 20 may be excluded from the source driver 11. In addition, as described above, since the plurality of pixel data DATA include a plurality of bits, the source driver 11 needs to have the plurality of level shifters 60. In FIG. 4, for description purpose, only a single level shifter 60 is illustrated. Likewise, the display panel 10 according to the embodiment in FIG. 3 includes 8 source lines B-B8 and thereby requiring 8 driving circuits. In FIG. 4, for description purpose, only a single driving circuit is illustrated.

Please refer again to FIG. 4. The data buffer circuit is coupled to the timing controller 13 shown in FIG. 3 and hence receiving the set signal SET, the clock signal CLK, and the plurality of pixel data DATA. The data buffer circuit is coupled to the plurality of level shifters 60 and outputs the plurality of pixel data DATA registered in the data buffer circuit to the plurality of level shifters 60. The plurality of level shifters 60 convert the voltage levels of the plurality of pixel data DATA and output the plurality of converted pixel data DATA to the plurality of coupled driving circuits. The plurality of driving circuits are coupled to the gamma circuit 20 and the display panel 10, and generate the plurality of source signals S1~S8 according to the plurality of converted pixel data DATA and the plurality of gamma signals V0~V63 for driving the display panel to display images.

The data buffer circuit in FIG. 4 receives and registers the plurality of pixel data DATA and outputs the plurality of pixel data DATA to the plurality of level shifters 60 directly. The data buffer circuit receives the plurality of pixel data DATA sequentially according to the clock signal CLK and latches the plurality of pixel data DATA for registering. Then the data buffer circuit outputs the plurality of pixel data DATA to the plurality of level shifters 60. In addition, during the periods when the gate driver 12 scans the plurality of gate lines B1~B6 of the display panel 10, the source driver 11 may transmit the plurality of source signals S1~S8 to the plurality of sub-pixels Sub-Pixel for driving the display panel 10 to display the image corresponding to the plurality of pixel data DATA. Thereby, each scan period when the gate driver 12 scans each of the gate lines B1~B6 is a driving period for the source driver 11 to drive each row of sub-pixels Sub-Pixel. In a driving period, for example, in a scan period when the gate driver 12 scans the gate line B1, the data buffer circuit receives and registers the plurality of pixel data DATA, and transmits the plurality of pixel data DATA to the plurality of level shifters 60. In addition, in this driving period, the plurality of level shifters 60 converts the voltage levels of the plurality of pixel data DATA registered in the data buffer circuit. Then in this driving period, the plurality of driving circuits generate the plurality of source signals S1~S8 according to the plurality of pixel data DATA converted by the plurality of level shifters 60.

The source driver 11 shown in FIG. 4 receives the plurality of pixel data DATA in a driving period and converts the voltage levels of the plurality of pixel data DATA in the driving period for generating the plurality of source signals S1~S8 and driving the display panel to display the image corresponding to the plurality of pixel data DATA. In this driving period, the pixel data DATA required for the displaying the image in the next driving period is not registered in advance. Thereby, compared to the source driver shown in FIG. 1 according to the prior art, the data buffer of the source driver shown in FIG. 4 may exclude the data latch 5. It means that data latch 5 may be saved and thus simplifying circuit and reducing its layout area.

Figure 1:
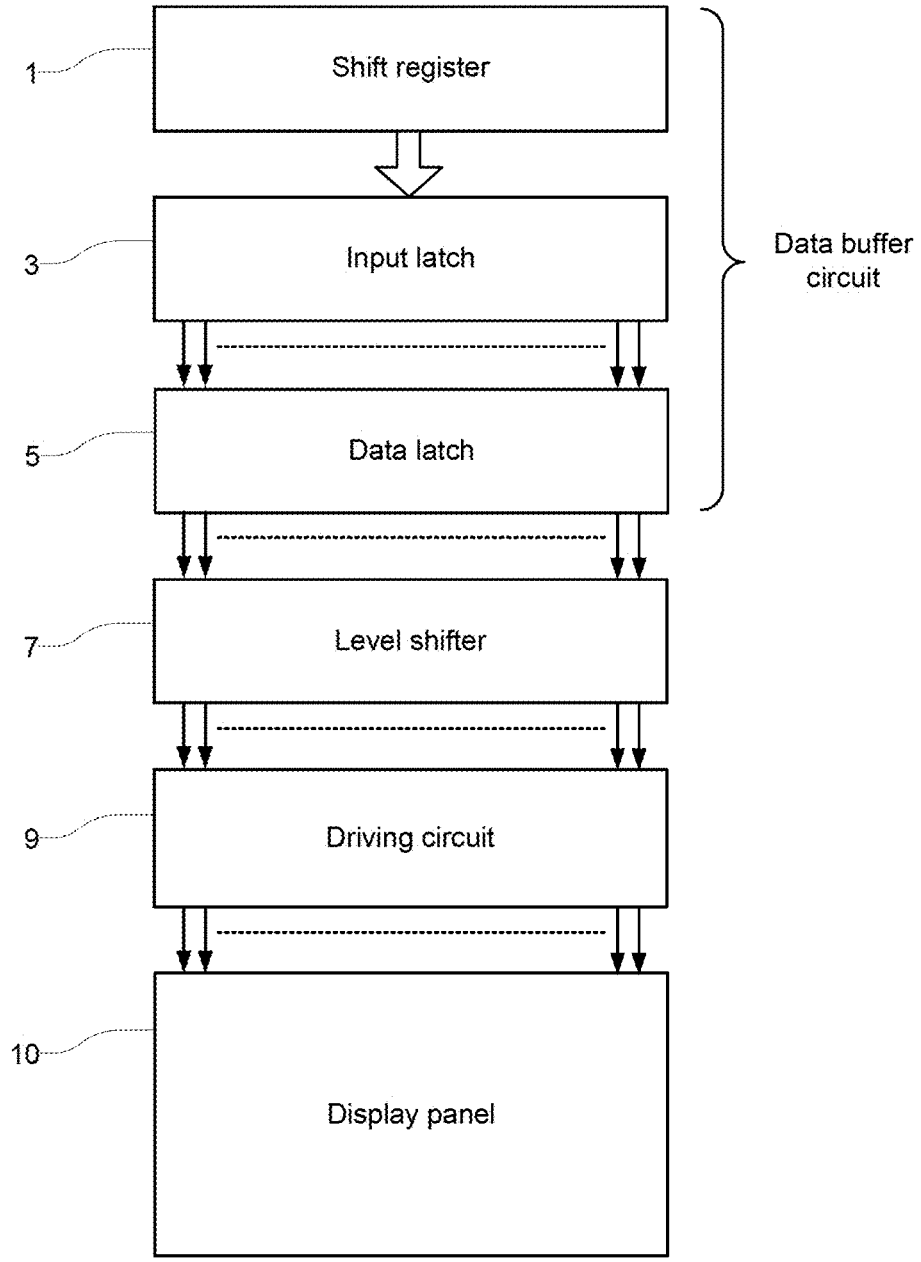
FIG. 1(Prior art)
FIG. 1 shows a circuit diagram of the display device according to the prior art.

The data buffer circuit according to the embodiment in FIG. 4 may include a latch control circuit 30 and an input latch 40, without the data latch 5 shown in FIG. 1. The latch control circuit 30 may be a shift register. The latch control circuit 30 receives the set signal SET, which may be a flag signal. Thereby, the latch control circuit 30 shifts the bit data of the set signal SET according to the clock signal CLK and generates a control signal Sc. Namely, the latch control circuit 30 generates the control signal Sc according to the clock signal CLK and the set signal SET. The latch control circuit 30 is coupled to the input latch 40 and controls the input latch 40 in the driving periods to latch the plurality of pixel data DATA for registering the plurality of pixel data DATA. The input latch 40 receives the plurality of pixel data DATA according to the clock signal CLK and latches the plurality of pixel data DATA according to the control signal Sc in the driving periods. Because the latch control circuit 30 shifts the bit data of the set signal SET according to the clock signal CLK for generating the control signal Sc, the control signal Sc may represent the order of the pixel data DATA being transmitted currently, for example, the third set of pixel data DATA. Thereby, the input latch 40 may latch the third set of pixel data DATA according to the control signal Sc.

Please refer again to FIG. 4. The driving circuit may include a plurality of digital-to-analog converters 70 and a plurality of output buffers 80. In FIG. 4, for description purpose, only a single digital-to-analog converter 70 and a single output buffer 80 are illustrated. Alternatively, the source driver 11 may include a plurality of driving circuits with each driving circuit including a single digital-to-analog converter 70 and a single output buffer 80. The plurality of digital-to-analog converters 70 are coupled to the plurality of level shifters 60. In a driving period, namely, the scan period for a scan line, the plurality of digital-to-analog converters 70 generate a plurality of pixel signals S70 according to the plurality of pixel data DATA converted by the plurality of level shifters 60. The plurality of output buffers 80 are coupled to the plurality of digital-to-analog converters 70 and generate the plurality of source signals S1~S8 according to the plurality of pixel signals S70 in this driving period for driving the display panel 10.

Furthermore, the gamma circuit 20 is coupled to the plurality of digital-to-analog converters 70 and generates the plurality of gamma signals V0~V63 to the plurality of digital-to-analog converters 70. The plurality of digital-to-analog converters 70 select the plurality of gamma signals V0~V63 according to the plurality of pixel data DATA converted by the plurality of level shifters 60 and generates the plurality of pixel signals S70. The gamma circuit 20 may include a series resistor R and a plurality of operational amplifiers 21. The plurality of operational amplifiers 21 provide a plurality of supply voltages to both terminals of the series resistor R for generating the plurality of gamma signals V0~V63 required for displaying different greyscales.

Figure 5:
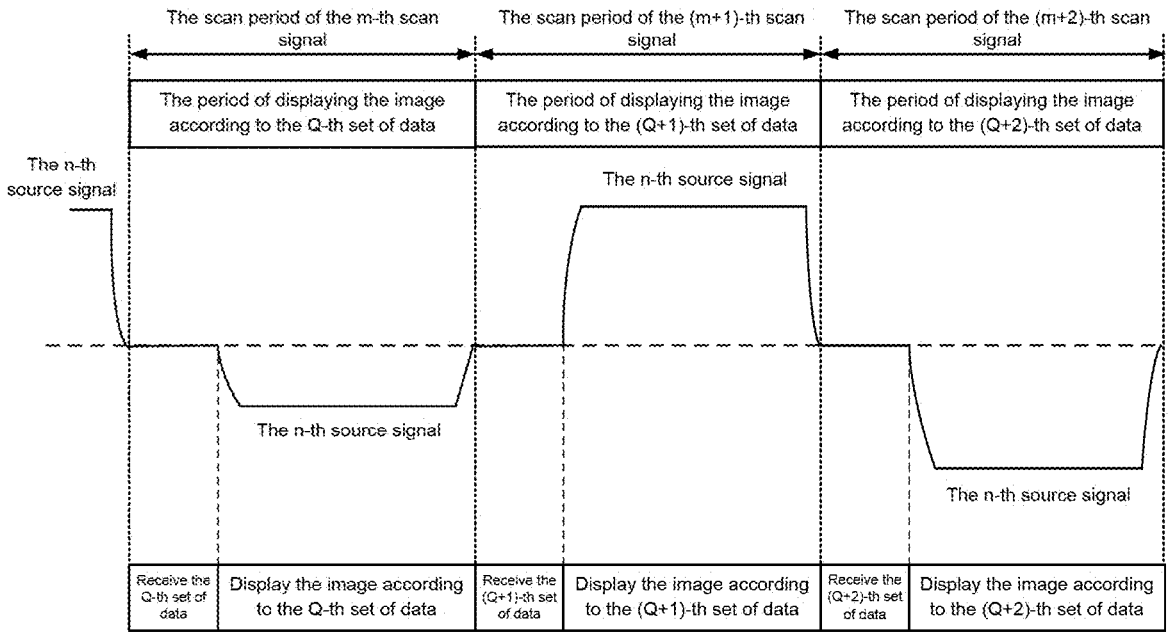
FIG. 5 shows a timing diagram of the operation of the source driver according to the embodiment of the present invention.

Please refer to FIG. 5, which shows a timing diagram of the operation of the source driver according to the embodiment of the present invention. As shown in the figure, in the scan period when the m-th scan signal scans the m-th gate line, for example the first gate line B1, the source driver 11 drives the n-th sub-pixel Sub-Pixel, for example, the third sub-pixel Sub-Pixel, on the m-th gate line for displaying the image corresponding to the Q-th set of data. Namely, the source driver 11 generates the n-th source signal to the n-th source line, for example, the third source signal S3 to the third source line A3, for driving the third sub-pixel Sub-Pixel on the first gate line B1. The driving period when the source driver 11 drives the plurality of sub-pixels Sub-Pixel coupled to the m-th gate line is equivalent to the scan period for the m-th gate line. In the scan period (the driving period) for the m-th gate line, the latch control circuit 30 controls the input latch 40 to latch the Q-th set of data. Since the embodiment in FIG. 3 adopts the source driver 11 for description, the Q-th set of data according to the embodiment in FIG. 5 may be the Q-th set of pixel data DATA. After receiving and latching the Q-th set of data in the scan period, the input latch 40 outputs the Q-th data to the plurality of level shifters 60. The plurality of level shifters 60 convert the voltage levels of the Q-th set of data. The converted voltage levels of the Q-th set of data may be middle or high voltage levels according to design requirements and the present invention is not limited by the choice of voltage levels. Afterwards, the digital-to-analog converter 70 of the driving circuit selects one of the gamma signals V0~V63 according to the converted Q-th set of data for generating the pixel signal S70. The output buffer 80 receives the pixel signal S70 and generates the n-th source signal for driving the n-th sub-pixel Sub-Pixel on the m-th gate line of the display panel 10 to display the image of the Q-th set of data. The voltage level of the n-th source signal varies according to the image content. Thereby, the voltage level shown in FIG. 5 is used for illustration.

Figure 2:
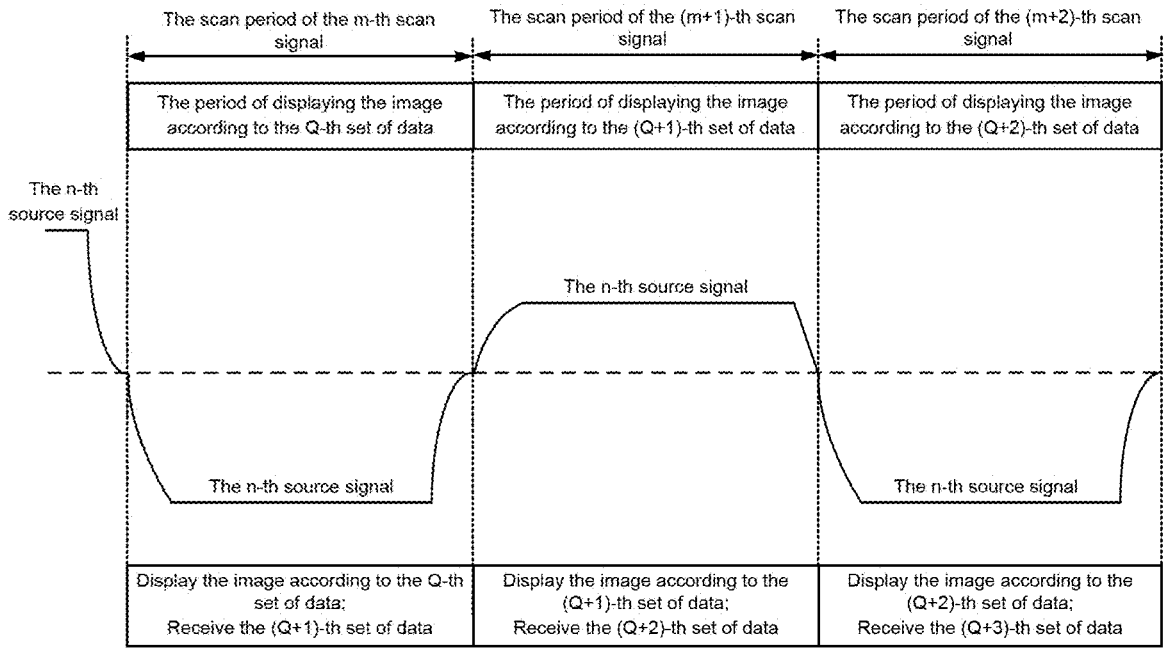
FIG. 2(Prior art)
FIG. 2 shows a timing diagram of the operation of the source driver according to the prior art.

Moreover, when the gate driver 12 outputs the (m+1)-th scan signal to scan the (m+1)-th gate line, for example, the second gate line B2, the data buffer circuit of the source driver 11 receives and registers the (Q+1)-th set of data in the scan period and outputs the (Q+1)-th set of data to the plurality of level shifters 60. Besides, the driving circuit of the source driver 11 generates the n-th source signal according to the (Q+1)-th set of data converted by the plurality of level shifters 60. In other words, the source driver 11 completes receiving and registering the (Q+1)-th set of data as described above in the scan period for the (m+1)-th scan signal and generates the n-th source signal corresponding to the (Q+1)-th set of data. Thereby, the present invention is different from the prior art, in which the source driver needs to register the (Q+1)-th set of data in advance and to generate the n-th source signal corresponding to the (Q+1)-th set of data in the two scan periods for the two scan lines m, m+1 as shown in FIG. 2. In other words, the present invention abandons the data registering method for first registering the data (for example the pixel data DATA) in the previous driving period of the prior art. Thereby, according to the present invention, the source driver 1 needs not to include the data latch 5 as shown in FIG. 1 according to the prior art and then the purpose of simplifying circuit and reducing layout area may be achieved. Likewise, the source driver 11 receives the (Q+2)-th set of data in the scan period (driving period) for the (m+2)-th scan signal, for example, the scan period for the third scan line B3, and generates the n-th source signal corresponding to the (Q+2)-th set of data. In addition, the Q–, (Q+1)-, and (Q+2)-th set of data as shown in FIG. 5 may include 1-bit or multiple-bit data. The present invention is not limited to the number of bits for data.

Figure 6:
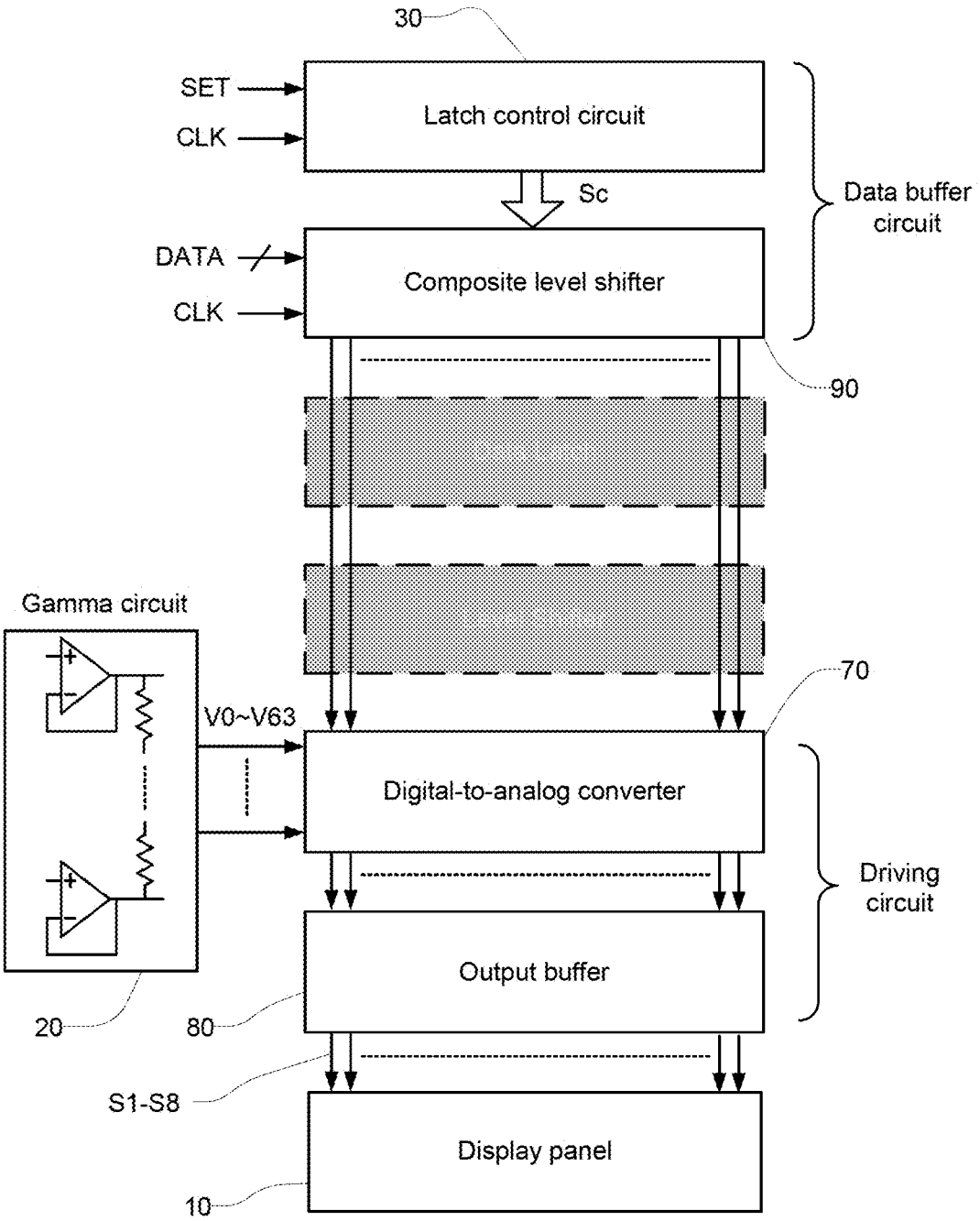
FIG. 6 shows a circuit diagram of the source driver according to the second embodiment of the present invention.

Please refer to FIG. 6, which shows a circuit diagram of the source driver according to the second embodiment of the present invention. As shown in the figure, the source driver 11 according to the embodiment in FIG. 6 excludes the level shifter 60 and the input latch 40 in the source driver 11 according to the embodiment in FIG. 4. The source driver 11 according to the embodiment in FIG. 6 comprises a data buffer circuit and a plurality of driving circuits. The data buffer circuit receives the plurality of pixel data DATA, converts the voltage levels of the plurality of pixel data DATA, and latches the plurality of converted pixel data DATA. The plurality of driving circuits are coupled to the data buffer circuit and generate the plurality of source signals S1~S8 according to the plurality of converted pixel data DATA. In other words, since the data buffer circuit is designed to include the function corresponding to the level shifter 60 for converting the voltage levels of data, the source driver 11 according to the embodiment in FIG. 6 may exclude the plurality of the level shifters 60, like the one Level Shifter framed by dashed lines in FIG. 6. In addition, the source driver 11 according to the embodiment in FIG. 6 also exclude the data latch 5 according to the prior art in FIG. 1, like the one DATA Latch framed by dashed line in FIG. 6. Thereby, likewise, the data buffer circuit and the plurality of driving circuits in FIG. 6 receive the plurality of pixel data DATA and generates the plurality of source signals S1~S8 in the scan period for one scan line. That is to say, the data buffer circuit receives the plurality of pixel data DATA, converts the voltage levels of the plurality of pixel data DATA, and latches the plurality of converted pixel data DATA in the driving period. The plurality of driving circuits generate the plurality of source signals S1~S8 according to the plurality of converted pixel data DATA in the driving period.

In addition to converting the voltage levels of the plurality of pixel data DATA, the data buffer circuit also latches the plurality of converted pixel data DATA. In other words, in addition to the function of converting the voltage levels of data, the data buffer circuit also includes the function of latching the converted data. As shown in FIG. 6, like the latch control circuit 30 in FIG. 4, the latch control circuit 30 of the data buffer circuit generates the control signal Sc. The details will not be described again. The difference between the data buffer circuits according to the embodiment in FIG. 6 and the one in FIG. 4 is that the data buffer circuit according to the embodiment in FIG. 6 includes a plurality of composite level shifters 90. Since the plurality of pixel data DATA include multiple-bit data, the data buffer circuit includes a plurality of composite level shifters 90 with the number varying according to the requirement in resolution. The plurality of composite level shifters 90 receive the plurality of data (the pixel data DATA), convert the voltage levels of the plurality of data (the pixel data DATA), and latch the plurality of converted data (the pixel data DATA).

Moreover, the plurality of composite level shifters 90 receive the control signal Sc output by the latch control circuit 30 and the clock signal CLK for latching the plurality of converted data according to the control signal Sc and the clock signal CLK. In other words, the plurality of composite level shifters 90 own both functions of converting the voltage levels of the data and latching (registering) the data and thus further simplifying the circuit of the source driver 11 and reducing the circuit area. Besides, FIG. 6 illustrates an embodiment for describing applying the composite level shifters 90 to the source driver 11. Thereby, the data processed by the composite level shifters 90 may be the pixel data DATA. According to another embodiment of the present invention, the plurality of composite level shifters 90 may receive another clock signal. Namely, the timing controller 13 generates another clock signal. It is not required that the plurality of composite level shifters must receive the clock signal CLK shown in FIG. 3.

Figure 7:
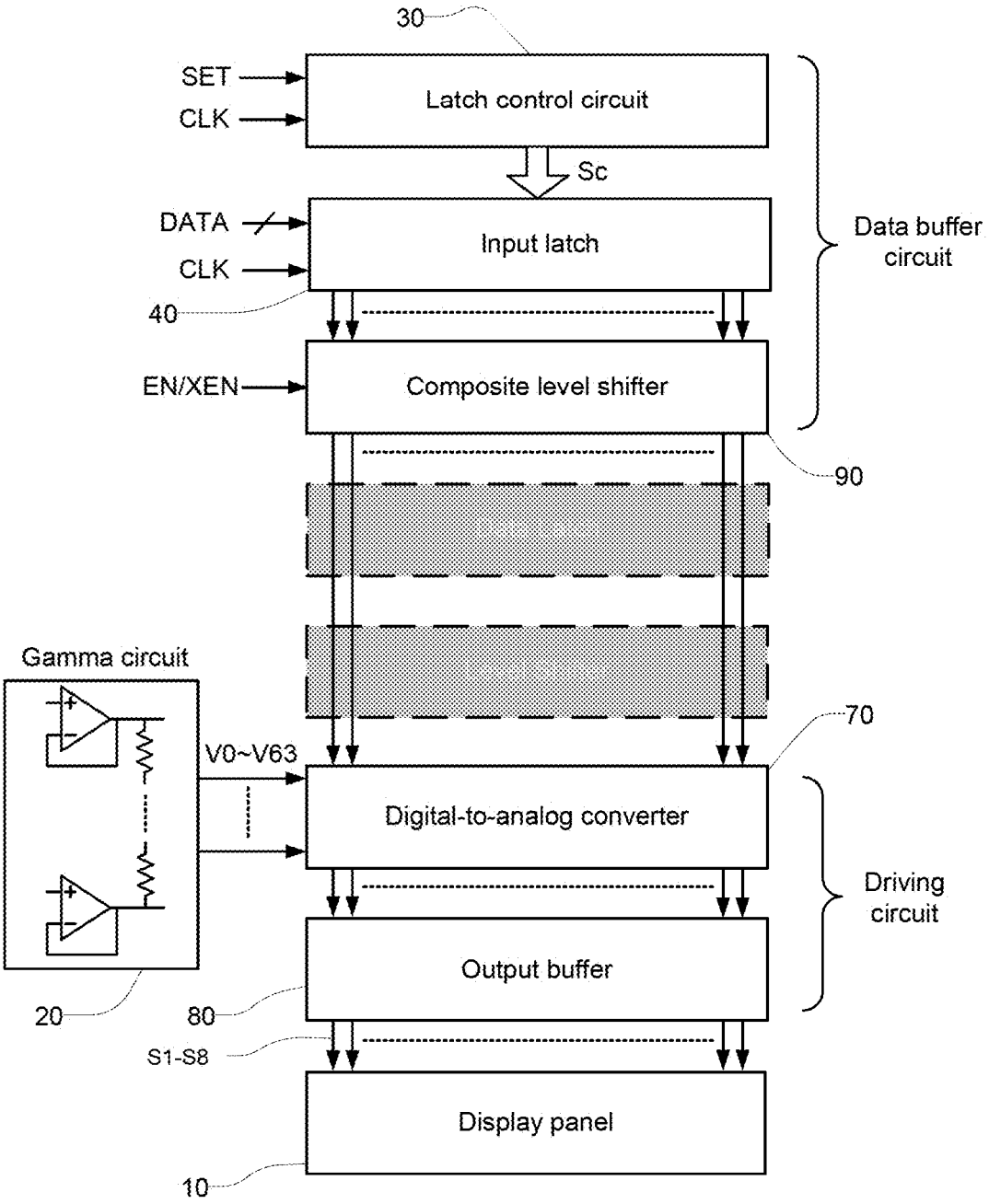
FIG. 7 shows a circuit diagram of the source driver according to the third embodiment of the present invention.

Please refer to FIG. 7, which shows a circuit diagram of the source driver according to the third embodiment of the present invention. As shown in the figure, compared to the embodiments in FIG. 4 and FIG. 6, the embodiment in FIG. 7 is another embodiment for the source driver 11. The data buffer circuit according to the embodiment in FIG. 7 includes the input latch 40 according to the embodiment in FIG. 4 and the plurality of composite level shifters 90 according to the embodiment in FIG. 6. The input latch 40 is coupled to the plurality of composite level shifters 90. In other words, after the data buffer circuit according to the embodiment in FIG. 7 receives the plurality of pixel data DATA, it latches the plurality of received pixel data DATA. Namely, the input latch 40 receives and registers the plurality of pixel data DATA. The plurality of composite level shifters 90 receives the plurality of pixel data DATA registered by the input latch 40 and converts the voltage levels of the plurality of pixel data DATA. In addition, the plurality of composite level shifters 90 latches the plurality of converted pixel data DATA. In other words, since the source driver 11 according to the embodiment in FIG. 7 owns the functions of the inputting and outputting latch data, the source driver 11 according to the embodiment in FIG. 7 may receive the data and generate the source signal in different scan periods, like the operation of the source driver according to the prior art as shown in FIG. 2. Alternatively, the source driver 11 according to the embodiment in FIG. 7 may receive the data and generate the source signal in the same scan period, like the embodiment in FIG. 5 according to the present invention.

Besides, the plurality of composite level shifters 90 according to the embodiment in FIG. 7 may further receive an enable signal EN/XEN. The plurality of composite level shifters 90 convert the voltage levels of the plurality of pixel data DATA and latch the plurality of converted pixel data DATA according to the enable signal EN/XEN. The enable signal EN/XEN may be generated by the timing controller 13.

Figure 8:
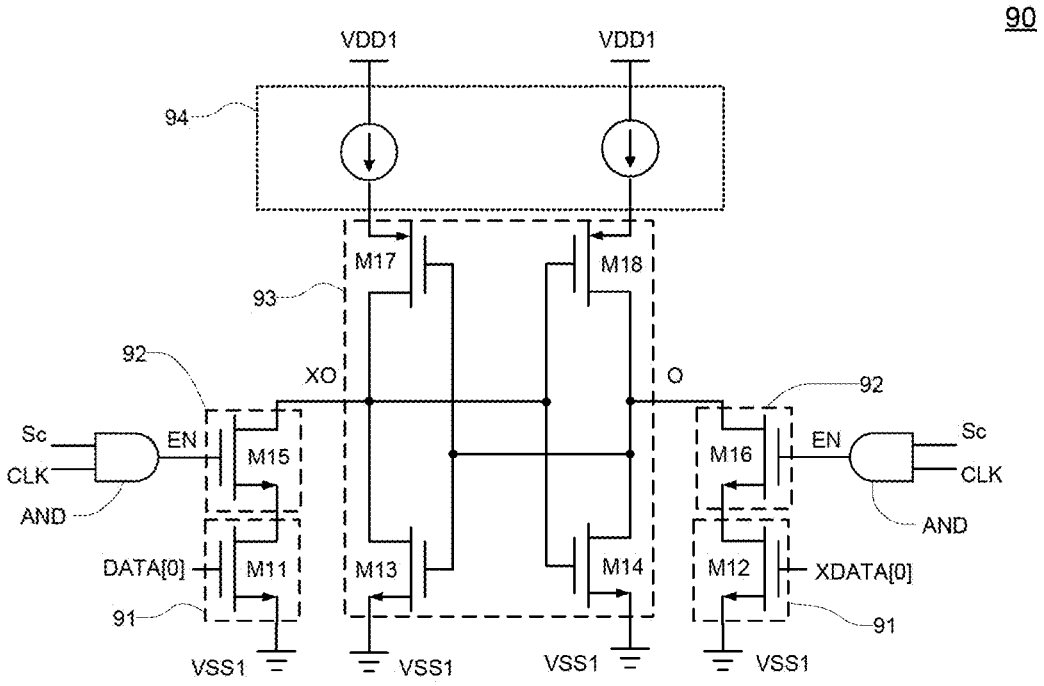
FIG. 8 shows a circuit diagram of the composite level shifter according to the first embodiment of the present invention.

Please refer to FIG. 8, which shows a circuit diagram of the composite level shifter according to the first embodiment of the present invention. As shown in the figure, each composite level shifter 90 comprises an input circuit 91, an enable circuit 92, and a composite circuit 93. The input circuit 91 receives the data, which may be, for example, the pixel data DATA. As shown in FIG. 8, the input circuit 91 receives the first bit of the pixel data DATA[0]. The composite circuit 93 is coupled to the input circuit 91 via the enable circuit 92, converts the voltage levels of the pixel data DATA, and latches the converted pixel data DATA. As shown in FIG. 8, the composite circuit 93 converts and latches the first bit of the pixel data DATA[0]. The enable circuit 92 is coupled to the composite circuit 93 and the input circuit 91, receives an enable signal EN, and controls the composite circuit 93 to convert the voltage levels of the pixel data DATA and latch the converted pixel data DATA. As shown in FIG. 8, the composite circuit 93 converts the voltage level of the first bit of the pixel data DATA[0] according to the first bit of the pixel data DATA[0] and outputs at the output terminal O. In other words, the composite level shifter 90 receives the first bit of the pixel data DATA[0] and converts the voltage level of the first bit of the pixel data DATA[0] for outputting the first bit of the pixel data DATA[0], which may be various voltage levels (higher or lower). In addition, the input circuit 91, the enable circuit 92, and the composite circuit 93 may be embodied by MOS transistors. Moreover, the composite level shifter 90 may further comprise a current limiter 94 coupled between the composite circuit 93 and a first input power source VDD1 for limiting an input current of the first input power source VDD1.

The voltage level of the inverse of the first bit of the pixel data DATA[0] is the inverse of the voltage level of the first bit of the pixel data DATA[0]. When the voltage level of the enable signal EN is high (1) and the voltage level of the first bit of the pixel data DATA[0] is high (1), a transistor M11 of the input circuit 91 is on and a transistor M12 of the input circuit 91 is off; a transistor M15 and a transistor M16 of the enable circuit 92 are on. The transistors M11, M12 are coupled to the first reference voltage VSS1, which can be, but not limited to, the ground voltage. The transistors M15, M16 are coupled to the transistors M11, M12. The transistors M11, M12, M15, M16 may be NMOS transistors. Thereby, the enable circuit 92 is coupled to the inverse output terminal of the composite level shifter 90, making the voltage level of the inverse output terminal XO be the voltage level of the first reference voltage VSS1. Since a gate of a transistor M18 and a gate of a transistor M14 of the composite circuit 93 are coupled to the inverse output terminal XO, the transistor M18 may be a PMOS transistor, and the transistor M14 may be an NMOS transistor, when the voltage level of the inverse output terminal XO is the voltage level of the first reference voltage VSS1, the transistor M18 is on and the transistor M14 is off. Thereby, the first input power source VDD1 coupled to a source of the transistor M18 charges the output terminal O of the composite level shifter 90, the voltage level of the output terminal O rises. In other words, the voltage level of the first bit of the pixel data DATA[0] is converted by the composite level shifter 90 to the voltage level of the first input power source VDD1. According to the embodiment in FIG. 8, the voltage level of the first bit of the pixel data DATA[0] is raised to the voltage level of the first input power source VDD1. The output terminal O may be a drain of the transistor M18. A drain of the transistor Ml4 is coupled to the drain of the transistor M18 and a source of the transistor M14 is coupled to the first reference voltage VSS1. Besides, the drain of the transistor M16 is also coupled to the output terminal O. The voltage level of the first input power source VDD1 is higher than the voltage source of the first reference voltage VSS1.

A gate of a transistor M17 of the composite circuit 93 and a gate of a transistor M13 are coupled to the output terminal O. The transistor M17 may be a PMOS transistor: the transistor M13 may be an NMOS transistor. Thereby, when the voltage level of the output terminal O is the voltage level of the first input power source VDD1, the transistor M17 is off and the transistor M13 is on. Hence, the first input power source VDD1 coupled to a source of the transistor M17 does not charge the inverse output terminal XO of the composite level shifter 90. Since the transistor M13 is on, the voltage level of the inverse output terminal XO is maintained at the voltage level of the first reference voltage VSS1. A drain of the transistor M13, a drain of the transistor M17, and a drain of the transistor M15 are coupled to form the inverse output terminal XO. Besides, a source of the transistor M13 is coupled to the first reference voltage VSS1.

When the composite level shifter 90 does not include the current limiter 94, the voltage level of the output terminal O is the voltage level of the first input power source VDD1. Contrarily, when the composite level shifter 90 includes the current limiter 94, the current limiter 94 limits the input current of the first input power source VDD1. Thereby, the final voltage level of the output terminal O may be determined by the current limiter 94.

Furthermore, when the voltage level of the first bit of the pixel data DATA[0] is low (0), the voltage level of the inverse of the first bit of the pixel data DATA[0] is high (1). As the enable signal EN is also at high voltage level (1), the transistor M11 of the input circuit 91 is off and the transistor M12 of the output circuit 91 is on. The transistors M15, M16 of the enable circuit 92 are both on. The voltage level of the output terminal O of the composite level shifter 90 is the voltage level of the first reference voltage VSS1. Thereby, the transistor M17 is on and the transistor M13 is off. Hence, the first input power source VDD1 charges the inverse output terminal XO of the composite level shifter 90, making the voltage level of the inverse output XO terminal rise. Likewise, the voltage level of the inverse output terminal XO differs depending on whether the current limiter 94 is included in the composite level shifter 90. In addition, each composite level shifter 90 may further comprise a logic circuit AND. According to an embodiment of the present invention, the logic circuit AND is an AND gate, which receives the control signal Sc of the latch control circuit 30 and the clock signal CLK of the timing controller 13 for generating the enable signal EN.

Besides, when the voltage level of the pixel data DATA received by the input circuit 91 changes from the high level (1) to the low level (0), since the voltage level of inverse output terminal XO has not risen to the level capable of turning off the transistor M18, the discharging capability of the transistor M12 for the output terminal O (the ability of pulling down the voltage level) must be greater than the charging capability of the first input power source VDD1 on the output terminal O via the transistor M18 (the ability of pulling up the voltage level). Thereby, when the composite level shifter 90 comprises the current limiter 94, the input current density of the first input power source VDD1 will be limited, meaning that the charging capability of the first input power source VDD1 on the output terminal O via the transistor M18 will be limited and thus facilitating the state transition of the voltage level of the output terminal O. Likewise, when the voltage level of the pixel data DATA received by the input circuit 91 changes from the low level (0) to the high level (1), the current limiter 94 facilitates the state transition of the voltage level of the inverse output terminal XO.

As described above, the composite level shifter 90 in FIG. 8 includes the function of latching (registering) data. Namely, when the voltage level of the enable signal EN is changed to the low level, the enable circuit 92 controls the composite circuit 93 to latch the voltage levels of the output terminal O and the inverse output terminal XO. That is, the enable circuit 92 controls the composite circuit 93 to latch the converted pixel data DATA. In addition, when the composite level shifter 90 is in the state of latching data, the current limiter 94 may raise the input current of the first input power source VDD1. In other words, the current limiter 94 lowers the ability of attenuating the input current. That is to say, the current limiter 94 may increase the ability of the composite level shifter 90 in latching the pixel data DATA for avoiding noise interference. Moreover, when the composite level shifter 90 is in the state of latching the pixel data DATA, the transistors M13, M14 of the composite circuit 93 may maintain the voltage levels of the output terminal O or the inverse output terminal XO at the voltage level of the first reference voltage VSS1.

Figure 9:
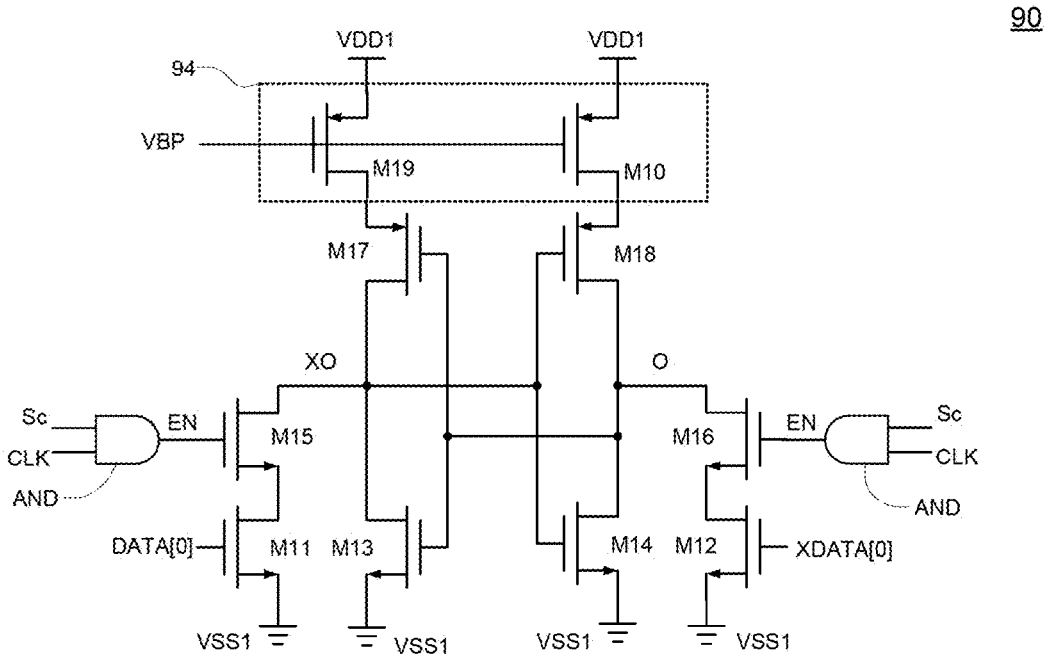
FIG. 9 shows a circuit diagram of the composite level shifter according to the second embodiment of the present invention.

Please refer to FIG. 9, which shows a circuit diagram of the composite level shifter according to the second embodiment of the present invention. As shown in the figure, a plurality of current sources in the current limiter 94 of the composite level shifter 90 may be embodied by transistors M10, M19, which may be PMOS transistors. The gates of the transistors M10, M19 are coupled to a first control voltage VBP, respectively. According to the voltage levels of the first control voltage VBP, the level of the current limiter 94 in limiting the input current of the first input power source VDD1 may be determined. The sources of the transistors M10, M19 are coupled to the first input power source VDD1, respectively. The drains of the transistors M10, M19 are coupled to the source of the transistor M17 and the source of the transistor M18, respectively.

Figure 10:
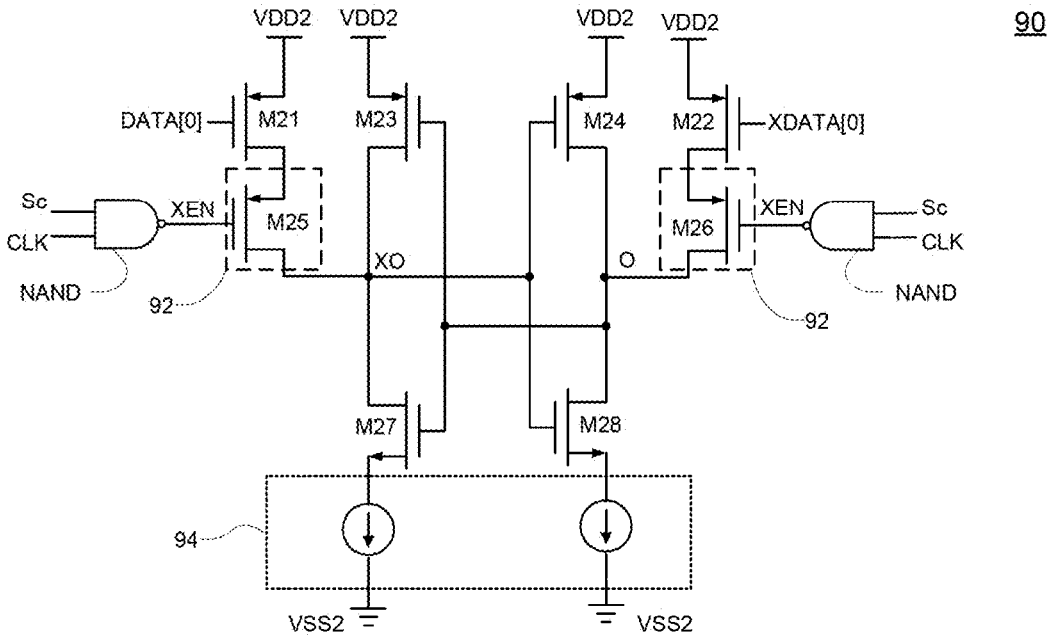
FIG. 10 shows a circuit diagram of the composite level shifter according to the third embodiment of the present invention.

Please refer to FIG. 10, which shows a circuit diagram of the composite level shifter according to the third embodiment of the present invention. As shown in the figure, the composite level shifter 90 may be embodied by the NMOS and PMOS transistors in FIG. 9. Alternatively, it may be embodied by the PMOS and NMOS transistors in FIG. 10. The difference between the embodiments is that the composite level shifter 90 in FIG. 10 is coupled to a second input power source VDD2 and a second reference voltage VSS2. The voltage level of the second input power source VDD2 is lower than the voltage of the first input power source VDD1; the voltage level of the second reference voltage VSS2 is lower than the voltage level of the first reference voltage VSS1. According to an embodiment of the present invention, the second reference voltage VSS2 may be a negative voltage. According to the present embodiment, the gates of transistors M25, M26 of the enable circuit 92 are coupled to the enable signal XEN. In addition, the composite level shifter 90 according to the present embodiment may further comprise a logic circuit NAND. According to an embodiment of the present invention, the logic circuit NAND is an exclusive AND gate, which receives the control signal Sc of the latch control circuit 30 and the clock signal CLK of the timing controller 13 for generating the enable signal XEN. The rest technologies are similar to the embodiment in FIG. 8. Hence, the details will not be described again.

Figure 11:
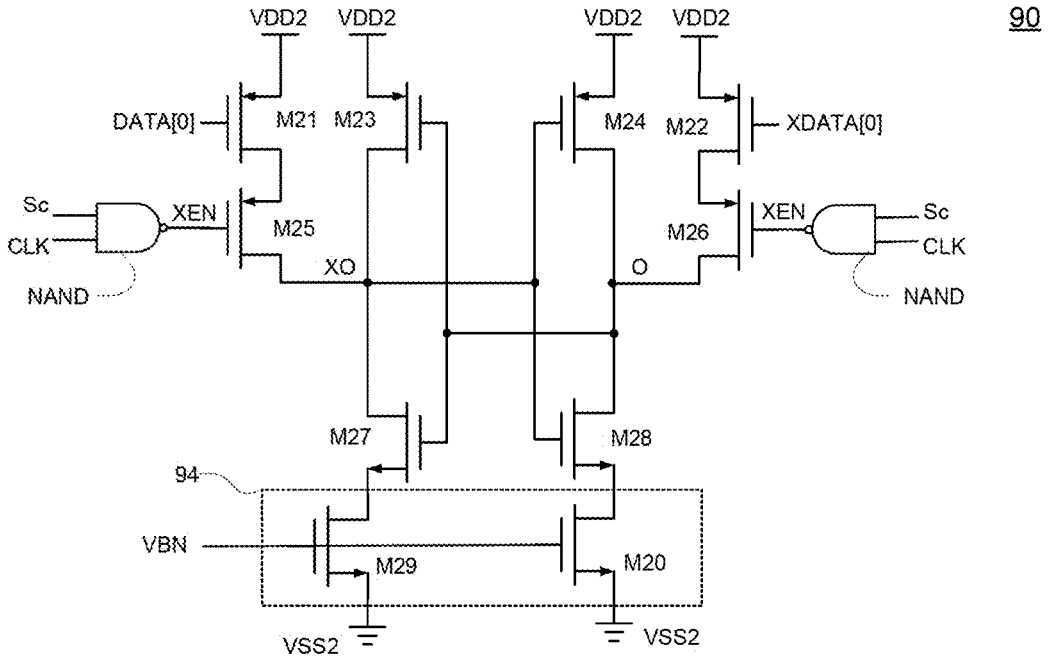
FIG. 11 shows a circuit diagram of the composite level shifter according to the fourth embodiment of the present invention.

Please refer to FIG. 11, which shows a circuit diagram of the composite level shifter according to the fourth embodiment of the present invention. As shown in the figure, the current limiter 94 may be embodiment by using NMOS transistors. The transistors M20, M29 are coupled to a second control voltage VBN, respectively. According to the voltage level of the second control voltage VBN, the limitation on the pulling-down ability of the second reference voltage VSS by the current limiter 94 may be determined.

To sum up, the present invention discloses a source driver, which comprises a data buffer circuit, a plurality of level shifters, and a plurality of driving circuits. The data buffer circuit receives and registers a plurality of pixel data in a driving period. The plurality of level shifters convert the voltage levels of the plurality of pixel data registered in the data buffer circuit in the driving period. The plurality of driving circuits generate a plurality of source signals according to the plurality of converted pixel data in the driving period. The source driver receives the plurality of pixel data in the driving period, and drives the display panel to display images according to the plurality of sources signals generated according to the received pixel data, instead of registering the pixel data required for displaying image in the next driving period in advance. Thereby, the circuit may be simplified and the circuit layout may be reduced.

The present invention relates to a source driver, which comprises a data buffer circuit and a plurality of driving circuits. The data buffer circuit receives a plurality of pixel data, converts the voltage levels of the plurality of pixel data, and latches the plurality of converted pixel data. The plurality of driving circuits are coupled to the data buffer circuits and generates a plurality of source signals according to the plurality of converted pixel data. Since the data buffer circuit may convert the voltage levels of the plurality of pixel data and latch the plurality of converted pixel data, the circuit may be simplified and the circuit layout may be reduced.

The present invention disclose a composite level shifter, which converts the voltage level of data and latches the converted data. Thereby, the circuit may be simplified and the circuit layout may be reduced.

The invention claimed is:

1. A source driver, comprising:

a data buffer circuit, receiving, registering, and latching a plurality of pixel data according to a clock signal, said plurality of pixel data corresponding to a plurality of pixels on a gate line;

a plurality of level shifters, coupled to said data buffer circuit, converting voltage levels of said plurality of pixel data received, registered and latched in said data buffer circuit; and a plurality of driving circuits, coupled to said plurality of level shifters, and generating a plurality of source signals according to said plurality of pixel data converted by said plurality of level shifters;

wherein said receiving, registering, latching, converting, and generating said plurality of source signals are completed in a driving period according to said clock signal, and wherein said driving period is a scan period for a gate driver scanning said gate line.

2. The source driver of claim 1, wherein said data buffer circuit includes:

a latch control circuit, outputting a control signal according to a set signal and said clock signal; and an input latch, coupled to said latch control circuit, receiving said plurality of pixel data in said driving period, and latching said plurality of pixel data according to said control signal.

3. The source driver of claim 1, wherein said plurality of driving circuits include:

a plurality of digital-to-analog converters, coupled to said plurality of level shifters, and generating a plurality of pixel signals according to said plurality of pixel data converted by said plurality of level shifters in said driving period; and a plurality of output buffers, coupled to said plurality of digital-to-analog converters, and generating said plurality of source signals according to said plurality of pixel signals in said driving period.

4. The source driver of claim 3, further comprising:

a gamma circuit, coupled to said plurality of digital-to-analog converters, generating a plurality of gamma signals, and said plurality of digital-to-analog converters selecting said plurality of gamma signals for generating said plurality of pixel signals according to said plurality of pixel data converted by said plurality of level shifters.

5. A source driver, comprising:

a data buffer circuit, receiving a plurality of pixel data, converting the voltage levels of said plurality of pixel data to form a plurality of converted pixel data, and latching said plurality of converted pixel data according to a clock signal, said plurality of pixel data corresponding to a plurality of pixels on a gate line; and a plurality of driving circuits, coupled to said data buffer circuit, and generating a plurality of source signals according to said plurality of converted pixel data;

wherein said receiving, converting, latching, and generating said plurality of source signals are completed in a driving period according to said clock signal, and wherein said driving period is a scan period for a gate driver scanning said gate line.

6. The source driver of claim 5, wherein said plurality of driving circuits include:

a plurality of digital-to-analog converters, coupled to said data buffer circuit, and generating a plurality of pixel signals according to said plurality of converted pixel data; and a plurality of output buffers, coupled to said plurality of digital-to-analog converters, and generating said plurality of source signals according to said plurality of pixel signals.

7. The source driver of claim 6, further comprising:

a gamma circuit, coupled to said plurality of digital-to-analog converts, generating a plurality of gamma signals, and said plurality of digital-to-analog converters selecting said plurality of gamma signals for generating said plurality of pixel signals according to said plurality of converted pixel data.

8. The source driver of claim 5, wherein said data buffer circuit includes:

a plurality of composite level shifters, receiving said plurality of pixel data, converting the voltage levels of said plurality of pixel data, and latching said plurality of converted pixel data.

9. The source driver of claim 8, wherein each of said composite level shifter includes:

an input circuit, receiving one bit of said pixel data;

a composite circuit, coupled to said input circuit and coupled to a reference voltage and an input power source, converting the voltage level of said pixel data according to said reference voltage and said input power source, and latching said converted pixel data; and an enable circuit, coupled to said composite circuit and said input circuit, said input circuit and said enable circuit coupled to said reference voltage, and said enable circuit receiving an enabling signal to control said composite circuit latch said converted pixel data.

10. The source driver of claim 9, wherein each of said composite level shifter includes:

a current limiter, coupled between said composite circuit and said input power source, and limiting an input current of said input power source.

11. The source driver of claim 8, wherein said data buffer circuit includes:

a latch control circuit, outputting a control signal to said plurality of composite level shifters according to a set signal and said clock signal, and said plurality of composite level shifters latching said plurality of converted pixel data according to said control signal.

12. The source driver of claim 8, wherein said data buffer circuit includes:

an input latch, coupled to said plurality of composite level shifters, and receiving and latching said plurality of pixel data;

wherein said plurality of composite level shifters receive said plurality of pixel data latched by said input latch.

13. A composite level shifter, receiving pixel data according to a clock signal, converting voltage levels of said pixel data to form a plurality of converted pixel data, and latching said converted pixel data, said pixel data corresponding to a plurality of pixels on a gate line, wherein said receiving, converting, and latching are completed in a driving period according to said clock signal, and wherein said driving period is a scan period for a gate driver scanning said gate line.

14. The composite level shifter of claim 13, comprising:

an input circuit, receiving said pixel data in said driving period;

a composite circuit, coupled to said input circuit and coupled to a reference voltage and an input power source, converting the voltage level of said pixel data in said driving period according to said reference voltage and said input power source, and latching said converted pixel data; and an enable circuit, coupled to said composite circuit and said input circuit, said input circuit and said enable circuit coupled to said reference voltage, and said enable circuit receiving an enable signal to control said composite circuit to latch said converted pixel data.

15. The composite level shifter of claim 14, further comprising:

a current limiter, coupled between said composite circuit and said input power source, and limiting an input current of said input power source.

* * * * *